US006280144B1

(12) United States Patent
Powers

(10) Patent No.: US 6,280,144 B1
(45) Date of Patent: Aug. 28, 2001

(54) PROPELLERS AND IMPELLERS WITH STRESS-RELIEVING RECESSES

(76) Inventor: Charles S. Powers, 439 Albany, Shreveport, LA (US) 71105

( * ) Notice: Subject to any disclaimer, the term of this patent is extended or adjusted under 35 U.S.C. 154(b) by 0 days.

(21) Appl. No.: 09/436,695

(22) Filed: Nov. 8, 1999

Related U.S. Application Data

(60) Provisional application No. 60/107,903, filed on Nov. 10, 1998.

(51) Int. Cl.[7] ..... F01D 5/14
(52) U.S. Cl. ..... 416/236 A; 416/228
(58) Field of Search ..... 416/236 A, 236, 416/228

(56) References Cited

U.S. PATENT DOCUMENTS

D. 110,871 * 8/1938 Preston ..... 416/236 R
120,849 * 11/1871 Broyhill et al. ..... 416/236
1,864,803 * 6/1932 Clark ..... 416/236
3,100,628 * 8/1963 Norris, Jr. ..... 416/236
3,746,467 * 7/1973 Buse ..... 416/228

* cited by examiner

*Primary Examiner*—Edward K. Look
*Assistant Examiner*—James M. McAleenan
(74) *Attorney, Agent, or Firm*—John M Harrison

(57) ABSTRACT

Propellers and impellers having multiple recesses or striations which are cast in the low-pressure face of each blade of the propeller and impeller and extend from the junction of the blade with the hub, toward the extending or distal end of the blade. The parallel or fan-like striations define a waffle-like pattern and act as stress relief pockets as they effect optimum uniform cooling of the blade and hub portions during setting of the poured propeller and impeller in the casting mold, to eliminate or reduce the formation of voids in each blade, as well as shrinkage and warpage along that segment of the blades which join the hub.

8 Claims, 1 Drawing Sheet

PROPELLERS AND IMPELLERS WITH STRESS-RELIEVING RECESSES

CROSS-REFERENCE TO RELATED APPLICATIONS

This application claims the benefit of copending U.S. Provisional Application Ser. No. 60/107,903, filed Nov. 10, 1998.

BACKGROUND OF THE INVENTION

FIELD OF THE INVENTION

This invention relates to propellers and impellers and more particularly, to marine propellers and impellers of all designs having multiple grooves, recesses or striations which are cast in the low pressure or trailing face of each blade of the propeller and impeller, each of which striations tapers from the junction of the blade with the hub, toward the extending or distal end of the blade. The parallel or fan-like striations define a waffle-like pattern and act as stress relief pockets to effect more uniform cooling of the relatively thin blade and thick hub portions of the poured propellers and impellers as the propellers and impellers set during the casting process. The striations have been found to eliminate, or at least reduce, formation of voids in the propeller blades, as well as shrinkage and warpage along that segment of each blade where the blades join the hub.

One of the problems encountered in casting marine propellers as well as impellers of all designs, is that of void formation in the blades, as well as shrinkage and warpage of the blades along that portion of each blade which joins the hub, as the poured propellers and impellers cool in the casting mold. Such void formations and warpages are caused by a disparity in the relative cooling rates of the hub and blade portions of the cast propellers and impellers, the thinner blade portions cooling and contracting at a more rapid rate than the thicker hub portion. It has surprisingly been found that casting a series of grooves, striations, recesses or stress relief pockets of selected depth in the trailing or low-pressure face of each blade of the propeller and impeller, each of which striations extends from the junction of the blade with the hub and tapers toward the extending or distal end of the blade, effects uniform or substantially uniform cooling and contracting rates of the blade and hub portions of the propeller and impeller. As a result, formation of voids in the blades, as well as shrinkage and warpage of the blades as the propellers and impellers set in the casting mold, is eliminated or substantially reduced.

Accordingly, an object of this invention is to provide propellers and impellers having grooves, recesses, striations or relief pockets cast in each blade thereof, to effect optimum uniform cooling rates of the hub and blade portions as the poured propellers and impellers set during the casting process.

Another object of this invention is to provide a propeller or impeller having multiple striations which are cast in the low-pressure or trailing face of each blade to effect uniform or nearly uniform cooling rates of the relatively thick hub and thin blade portions of the poured propeller or impeller, and thus define relief pockets that prevent or reduce formation of voids throughout the thickness of the blade as the propellers or impellers set during the casting process.

Still another object of this invention is to provide a marine propeller having multiple, parallel or fan-like striations or stress relief pockets which are cast in the trailing face of each blade of the propeller and extend from the junction of the blade with the propeller toward the extending or distal end of the blade, to effect uniform or nearly uniform cooling and contracting rates of the thick hub and thin blade portions of the propeller and thereby prevent, or at least reduce, shrinkage and warpage of the propeller blades along that portion of each blade which joins the hub, as the poured propeller sets and cools in the casting mold during the propeller casting process.

Yet another object of this invention is to provide a new and improved method of casting a marine propeller and impellers of all designs, including the step of casting a series of elongated, essentially parallel and/or fan-like striations, relief pockets or recesses of selected varying depth in the trailing face of each blade thereof, each of which striations, relief pockets or recesses tapers from a maximum depth at the junction of the blade with the hub toward the extending end of the blade to a minimum depth to achieve uniform or substantially uniform rates of cooling of the blades and hub of the poured propeller or impeller and prevent or reduce formation of voids in the respective blades, as well as shrinkage and warpage along that portion of each blade which joins the hub, as the propeller or impeller sets and cools in the casting mold.

SUMMARY OF THE INVENTION

These and other objects of the invention are provided in marine propellers as well as impellers and a method of casting propellers and impellers with multiple, parallel and/or fan-like striations or recesses in each blade thereof, each of which striations is cast in the low-pressure or trailing face of the propeller or impeller blade to define a discrete relief pocket and tapers from a maximum depth the junction of the blade with the hub, toward the extending end of the blade to a minimum depth. The striations facilitate uniform or nearly uniform cooling rates of the hub and blade portions of the propeller or impeller as the poured wheel cools in the casting mold, thus preventing or minimizing formation of voids in the respective blades and shrinkage and warpage of each blade along that portion of the blade which joins the hub.

BRIEF DESCRIPTION OF THE DRAWINGS

The invention will be better understood by reference to the accompanying drawing, wherein.

DESCRIPTION OF THE PREFERRED EMBODIMENTS

Figure 1:
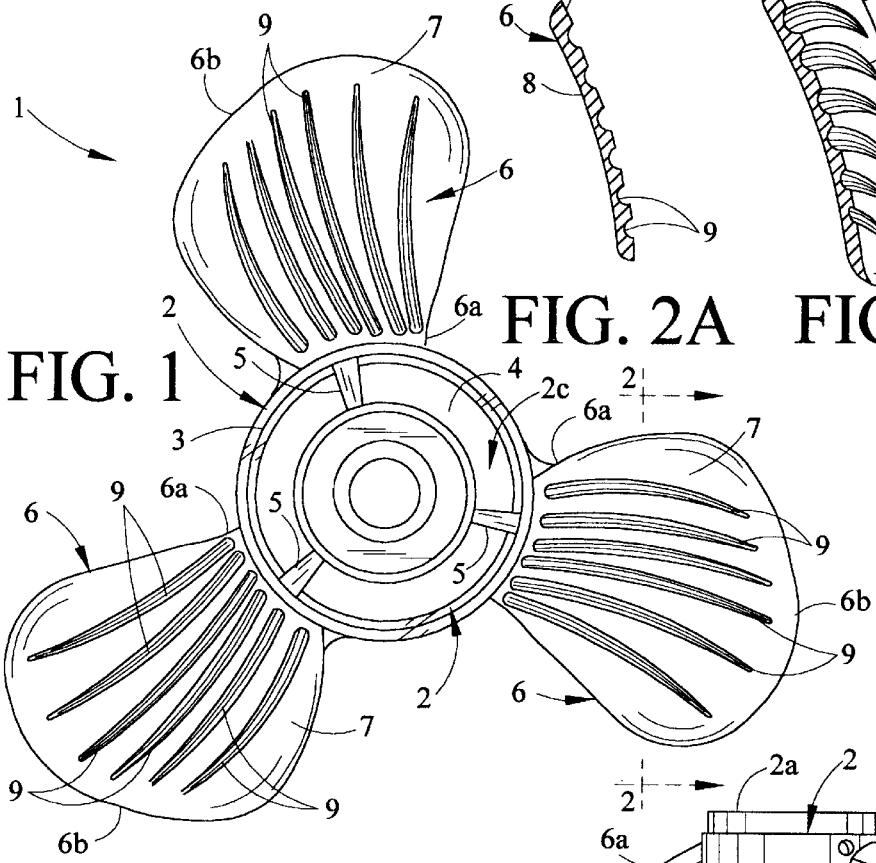
FIG. 1 is a rear view of a marine propeller with typical blade striations of this invention, provided in the low-pressure or trailing face of each propeller blade.
Figure 2A:
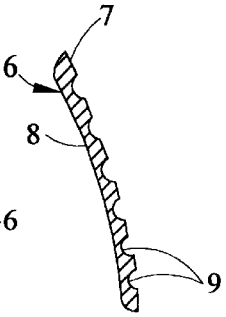
FIG. 2*a* is a sectional view, taken along section lines 2—2 in FIG. 1, of a blade of the marine propeller with blade striations.
Figure 2B:
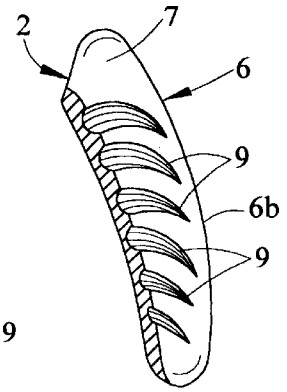
FIG. 2*b* is an oblique sectional view taken along section lines 2—2 of the blade.
Figure 3:
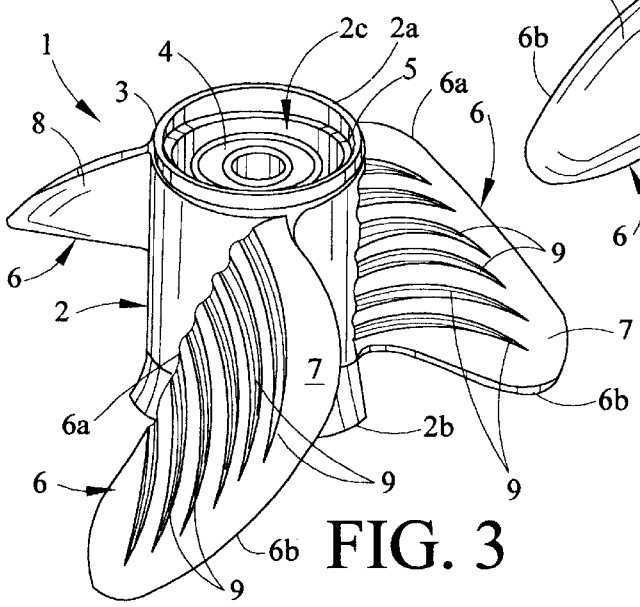
FIG. 3 is a perspective view of the marine propeller with blade striations illustrated in FIG. 1.
Figure 4:
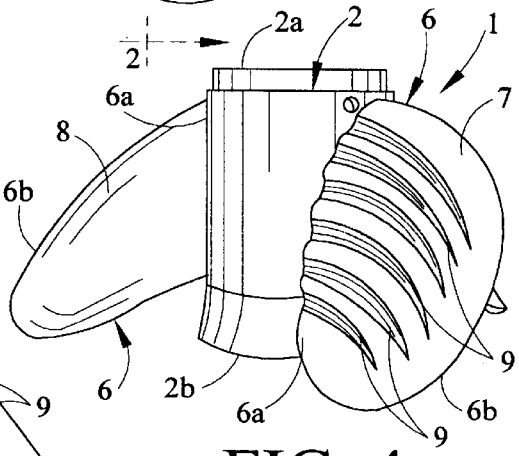
FIG. 4 is a side view of the marine propeller with blade striations illustrated in FIGS. 1–3.

Referring to FIGS. 1–4 of the drawing, in a preferred embodiment the marine propeller with stress-relieving recesses or blade striations, hereinafter referred to as the marine propeller, of this invention is generally illustrated by reference numeral 1. As illustrated in FIGS. 1–4, the marine propeller 1 is typically characterized by an elongated, substantially cylindrical hub 2 having a flared trailing end 2*b* and a front or leading end 2*a* which faces forwardly when the marine propeller 1 is mounted in functional configuration on the motor shaft (not illustrated) of a marine engine (also not illustrated). A splined motor shaft collar 4, secured in the hub bore 2*c* of the hub 2 typically by means of collar ribs 5, as illustrated in FIG. 1, receives the cooperating, splined motor shaft extending from the motor (not illustrated) provided on the marine engine, in conventional fashion. Each of multiple propeller blades 6 includes a low-pressure or trailing face 7 and a high-pressure or leading face 8 for rotation through a water body as the marine propeller 1 traverses the water body and propels a watercraft on the water body in conventional fashion. Multiple, elongated, parallel and/or fan-like grooves, recesses or striations 9 are cast in the trailing face 7 of each propeller blade 6 during casting of the marine propeller 1 in a casting mold (not illustrated), according to the knowledge of those skilled in the art, and each striation 9 tapers from a selected depth at the proximal end 6*a* of the blade 6 which joins the hub 2, a selected distance and in decreasing depth, toward the distal or extending end 6*b* of the blade 6, as illustrated. Accordingly, the striations 9 facilitate uniform or nearly uniform cooling rates of the relatively thick hub 2 and thin blade 6 portions of the marine propeller 1 and act as stress relief pockets as the poured marine propeller 1 cools in the casting mold, thus eliminating, or at least reducing, voids in each propeller blade 6, as well as shrinkage and warpage along that portion of the propeller blade 6 which joins the hub 2.

It will be appreciated by those skilled in the art that the striations 9 of this invention can be cast in the propeller blades 6 of virtually any type or size of the marine propeller 1, as well as impellers of all design, to reduce or eliminate void formation and blade warpage as the poured impeller or marine propeller 1 sets and cools during the casting process, as described above. Furthermore, the striations 9 can be provided at selected depths, widths and lengths, as well as spacing, and parallel or fan-like orientation on either the trailing face 7, as illustrated and described, or on the leading face 8 of the propeller blade 6, although the former configuration is preferred for optimum performance of the marine propeller 1.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. In a method of casting a marine propeller or impeller comprising a hub and at least two blades provided on said hub, each of said at least two blades having a proximal end joined to said hub and a distal end spaced from said proximal end, the improvement comprising the step of casting at least one striation in each of said at least two blades at said proximal end of said each of said at least two blades.

2. The method of claim 1 wherein said step of casting at least one striation in said blades comprises the step of casting multiple striations in said blades.

3. The method of claim 1 wherein each of said blades includes a leading face and a trailing face, and wherein said at least one striation is cast in said trailing face of said each of said at least two blades.

4. The method of claim 1 wherein said step of casting at least one striation comprises the step of casting multiple striations in said blades and wherein said each of said blades includes a leading face and a trailing face, and wherein said at least one striation is cast in said trailing face of said each of said at least two blades.

5. The method of claim 1 wherein said at least one striation extends from said proximal end toward said distal end of said each of said blades.

6. The method of claim 5 wherein said step of casting at least one striation comprises the step of casting multiple striations in said blades.

7. The method of claim 5 wherein each of said blades includes a leading face and a trailing face, and wherein said at least one striation is cast in said trailing face of said each of said blades.

8. The method of claim 5 wherein said step of casting at least one striation comprises the step of casting multiple striations and each of said blades includes a leading face and a trailing face, and wherein said at least one striation is cast in said trailing face of said each of said blades.

* * * * *